US009127422B2

(12) United States Patent
Ball

(10) Patent No.: US 9,127,422 B2
(45) Date of Patent: Sep. 8, 2015

(54) BOLLARDS

(75) Inventor: Robert N Ball, Cheshire (GB)

(73) Assignee: ATG ACCESS LTD. (GB)

( * ) Notice: Subject to any disclaimer, the term of this patent is extended or adjusted under 35 U.S.C. 154(b) by 0 days.

(21) Appl. No.: 13/981,980

(22) PCT Filed: Jan. 27, 2012

(86) PCT No.: PCT/GB2012/050176

§ 371 (c)(1),
(2), (4) Date: Sep. 20, 2013

(87) PCT Pub. No.: WO2012/101452

PCT Pub. Date: Aug. 2, 2012

(65) Prior Publication Data

US 2014/0017003 A1 Jan. 16, 2014

(30) Foreign Application Priority Data

Jan. 28, 2011 (GB) ..... 1101514.6

(51) Int. Cl.

| | |
|---|---|
| ***E01F 15/00*** | (2006.01) |
| ***E01F 9/011*** | (2006.01) |
| ***E01F 13/12*** | (2006.01) |

(52) U.S. Cl.

CPC ..... *E01F 15/003* (2013.01); *E01F 9/011* (2013.01); *E01F 9/0117* (2013.01); *E01F 13/12* (2013.01); *Y10T 29/49716* (2015.01); *Y10T 29/49826* (2015.01)

(58) Field of Classification Search

CPC ..... E01F 9/0175; E01F 15/146; E01F 13/12; E01F 13/00

See application file for complete search history.

(56) References Cited

U.S. PATENT DOCUMENTS

| | | | |
|---|---|---|---|
| 1,574,908 | A | 3/1926 | Lamp |
| 1,848,516 | A | 3/1932 | Davison |
| 2,006,233 | A | 6/1935 | Chretien |
| 2,263,649 | A | 11/1941 | Sawyer |

(Continued)

FOREIGN PATENT DOCUMENTS

| | | |
|---|---|---|
| CH | 700218 | 7/2010 |
| DE | 2309249 | 8/1974 |

(Continued)

OTHER PUBLICATIONS

GB Combined Search and Examination Report corresponding to GB1214276.6 dated Mar. 19, 2013.

(Continued)

*Primary Examiner* — Abigail A Risic

(74) *Attorney, Agent, or Firm* — Niels Haun; Dann Dorfman Herrell & Skillman, PC

(57) ABSTRACT

A bollard apparatus for use as a fixed vehicle barrier including a bollard member having a base end and a foundation assembly adapted for fixed ground engagement. The foundation assembly comprises a housing part dimensioned and arranged for retaining the base end of the bollard member together with cementing material for cementing the bollard member to the foundation assembly within the housing part. The inclination of the bollard member relative to the foundation assembly is adjustable while the cementing material is not set (e.g. cured or hardened or rigid) and is fixed upon the cementing material becoming set thereby to cement the inclination of the bollard member relative to the foundation assembly.

10 Claims, 11 Drawing Sheets

(56) References Cited

U.S. PATENT DOCUMENTS

| | | | | |
|---|---|---|---|---|
| 3,810,595 | A | 5/1974 | Doolittle | |
| 3,861,097 | A | 1/1975 | Patterson | |
| 4,240,766 | A | 12/1980 | Smith | |
| 4,576,508 | A | 3/1986 | Dickinson | |
| 4,844,653 | A | 7/1989 | Dickinson | |
| 4,919,563 | A | 4/1990 | Stice | |
| 4,973,189 | A | 11/1990 | Bechtold | |
| 5,474,017 | A | 12/1995 | Mohebbi | |
| 5,481,828 | A | 1/1996 | Kentrotas | |
| 5,547,310 | A | 8/1996 | Muller | |
| 5,829,912 | A | 11/1998 | Marcotullio | |
| 5,975,792 | A | 11/1999 | Goeken | |
| 6,174,103 | B1 | 1/2001 | Stroman | |
| 6,435,760 | B1 | 8/2002 | Pettesch | |
| 6,626,606 | B1 | 9/2003 | Johnson | |
| 7,244,075 | B2 | 7/2007 | Stadler | |
| 7,607,856 | B2 | 10/2009 | Patel | |
| 7,850,391 | B2 * | 12/2010 | Omar | 404/6 |
| 8,096,727 | B2 | 1/2012 | Parenti | |
| 8,197,156 | B2 * | 6/2012 | Morgan et al. | 404/6 |
| 8,215,865 | B2 * | 7/2012 | Adler et al. | 404/6 |
| 8,277,143 | B2 * | 10/2012 | Adler et al. | 404/6 |
| 8,523,479 | B2 * | 9/2013 | Adler et al. | 404/6 |
| 2003/0051406 | A1 | 3/2003 | Ritz | |
| 2003/0145498 | A1 | 8/2003 | Venegas | |
| 2004/0091315 | A1 | 5/2004 | Yodock | |
| 2004/0151542 | A1 | 8/2004 | Johnson | |
| 2004/0159055 | A1 | 8/2004 | Stone | |
| 2005/0031411 | A1 | 2/2005 | Hensley | |
| 2005/0073275 | A1 | 4/2005 | Robb | |
| 2005/0098770 | A1 | 5/2005 | Schell | |
| 2006/0204327 | A1 * | 9/2006 | Phelan | 404/6 |
| 2006/0233608 | A1 | 10/2006 | Netah | |
| 2007/0031189 | A1 | 2/2007 | Stadler | |
| 2007/0086858 | A1 | 4/2007 | Morgan | |
| 2007/0258762 | A1 | 11/2007 | Stice | |
| 2008/0038056 | A1 | 2/2008 | Patel | |
| 2008/0038057 | A1 | 2/2008 | Stadler | |
| 2008/0112756 | A1 | 5/2008 | Omar | |
| 2008/0187396 | A1 * | 8/2008 | McCue et al. | 404/6 |
| 2009/0047066 | A1 | 2/2009 | Stice | |
| 2009/0202296 | A1 | 8/2009 | Lamore | |
| 2009/0208285 | A1 * | 8/2009 | Adler et al. | 404/6 |
| 2009/0250674 | A1 | 10/2009 | Darcy | |
| 2010/0166498 | A1 * | 7/2010 | Adler et al. | 404/6 |
| 2010/0290832 | A1 | 11/2010 | House | |
| 2011/0033232 | A1 * | 2/2011 | Adler et al. | 404/6 |
| 2012/0230764 | A1 | 9/2012 | Lafont | |
| 2012/0251236 | A1 * | 10/2012 | Hild et al. | 404/6 |
| 2012/0308302 | A1 * | 12/2012 | Adler et al. | 404/6 |
| 2013/0034387 | A1 * | 2/2013 | Adler et al. | 404/6 |
| 2014/0003867 | A1 | 1/2014 | Ball | |
| 2014/0010591 | A1 | 1/2014 | Ball | |
| 2014/0017003 | A1 | 1/2014 | Ball | |
| 2014/0119825 | A1 | 5/2014 | Castro | |
| 2014/0147201 | A1 | 5/2014 | Ball | |
| 2014/0161521 | A1 | 6/2014 | Ball | |
| 2014/0161523 | A1 | 6/2014 | Ball | |

FOREIGN PATENT DOCUMENTS

| | | | |
|---|---|---|---|
| DE | 3605747 | | 8/1987 |
| DE | 9316170 | | 3/1994 |
| DE | 9315671 | | 6/1994 |
| DE | 19631678 | | 2/1998 |
| DE | 19812116 | | 9/1999 |
| DE | 19815426 | | 10/1999 |
| DE | 202005013439 | | 11/2005 |
| DE | 102007052321 | A1 | 5/2009 |
| EP | 0176973 | | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2598484 | | 11/1987 |
| FR | 2621625 | | 4/1989 |
| FR | 2680190 | | 7/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 2775992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2012 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | | 2/1987 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | | 5/2009 |
| WO | 9709485 | | 3/1997 |
| WO | 2004048702 | | 6/2004 |
| WO | 2004099534 | | 11/2004 |
| WO | 2007001326 | | 1/2007 |
| WO | 2007008813 | | 1/2007 |
| WO | 2007018531 | A1 | 2/2007 |
| WO | 2007191977 | | 8/2007 |
| WO | 2007103394 | | 9/2007 |
| WO | 2009112159 | | 9/2009 |
| WO | 2010132616 | | 11/2010 |
| WO | 2013017837 | | 2/2013 |

OTHER PUBLICATIONS

GB Examination Report corresponding to GB 1214276.6 dated Jul. 22, 2013.

GB Search Report corresponding to GB 1113203.2 dated Jan. 25, 2012.

GB Search Report corresponding to GB1109010.7 dated Sep. 16, 2011.

GB Search Report corresponding to GB1214276.6 dated Nov. 17, 2012.

International Search Report corresponding to Application No. PCT/GB2012/051755 dated Mar. 12, 2013.

International Search Report corresponding to PCT/GB2012/051198 dated Aug. 30, 2012.

Written Opinion of the International Searching Authority corresponding to PCT/GB2012/051198 dated Aug. 30, 2012.

Written Opinion of the International Searching Authority corresponding to PCT/GB2012/051755 dated Mar. 12, 2013.

Search Report corresponding to Application No. GB1101513.8 dated May 26, 2011.

GB Combined Search and Examination Report corresponding to Application No. GB1214248.5 dated Aug. 29, 2012.

GB Search Report corresponding to Application No. GB1101514.6 dated May 27, 2011.

GB Combined Search and Examination Report corresponding to GB1214278.2 dated Dec. 10, 2012.

(56) References Cited

OTHER PUBLICATIONS

GB Search Report corresponding to GB1104802.2 dated May 25, 2012.
GB Search Report corresponding to GB1113211.5 dated Jan. 17, 2012.
International Search Report corresponding to PCT/GB2012/050175 dated May 23, 2012.
Written Opinion of the International Search Authority corresponding to PCT/GB2012/050176 dated May 21, 2012.
Written Opinion of the International Search Authority corresponding to PCT/GB2012/050173 dated May 22, 2012.
Written Opinion of the International Search Authority corresponding to PCT/GB2012/050175 dated May 23, 2012.
International Search Report corresponding to PCT/GB2012/050176 dated May 21, 2012.
International Search Report corresponding to PCT/GB2012/050173 dated May 22, 2012.
Search Report with abstracts and figures Aug. 18, 2010.
Search Report with abstracts and figures Aug. 19, 2010.
Search Report with abstracts and figures Aug. 19, 2010—bis.
Search Report with abstracts and figures Aug. 20, 2010.
Search Report with abstracts and figures Oct. 2, 2010.
Search Report with abstracts and figures Mar. 23, 2015.

* cited by examiner

BOLLARDS

RELATED APPLICATIONS

This application is a 371 application of International Application No. PCT/GB2012/050176 filed Jan. 27, 2012, which claims priority to United Kingdom Patent Application No. 01101514.6 filed Jan. 28, 2011. Each of the foregoing applications is hereby incorporated herein by reference.

The invention relates to bollards and particularly, though not exclusively, to shallow-mountable bollards for use as vehicle impact barriers.

Bollards forming fixed barriers around buildings or terrain are often required to be mounted within an excavation dug into the ground and the base of the bollard buried there. Ground engaging bollards of this type are typically used to provide impact-resistant barriers for resisting impacts from vehicles or the like. In order to provide sufficient resistance to transverse impact forces, such bollards typically require a significant depth of excavation, which may amount to a depth of the order of a meter or more. This is to ensure that the buried end of the bollard is unlikely to become unearthed or move significantly if a vehicle impacts the bollard.

The requirement to excavate deeply increases the labour, cost and difficulty in erecting such bollards and barriers. Indeed, buried power cables, piping or other important buried articles may be located at the depth required to be excavated for such a bollard and may prevent the bollard from being mounted there.

A "shallow-mount" bollard is the term generally given to ground-engaging bollards, often for use in impact-resistant barriers, possessing a significant laterally extending base, foundation or foot part, fixed at the base of the upstanding bollard body, for engaging and extending across the ground at the base of an excavation which is subsequently filled in to bury the foot part (e.g. with earth, concrete or cement). The foot part provides support and resistance to significant lateral impact forces that may be applied to the upstanding bollard, and requires a much shallower excavation to accommodate it than is required for other types of impact-resistant bollard.

However, the fixed inclination of the upstanding bollard body of such shallow-mount bollards, relative to the laterally projecting of the foot part, prevents easy adjustment of the inclination of the upstanding bollard body relative to local ground levels. This is because a change in the inclination of the bollard body results in a change in the inclination of the foot part and, therefore, a change in the change in the orientation of the foot part relative to the ground surface (the base of the excavation) upon which it rests. Such a change may disengage portions of the foot part from the ground surface it otherwise would engage. To retain the desired engagement between local ground surface and the foot part of the bollard assembly may require providing the local ground surface (e.g. the base of an excavation) with a suitably inclined surface. This is difficult to achieve with accuracy and is labour intensive.

The invention aims to provide means and methods which may be used to help address these and other problems and desirably to provide a suitable bollard assembly at reduced cost and labour.

In a first of its aspects, the invention may provide a bollard apparatus for use as a fixed vehicle barrier including:

a bollard member having a base end; and, a foundation assembly adapted for fixed ground engagement;

wherein the foundation assembly defines a housing part dimensioned and arranged for retaining the base end of the bollard member together with cementing material for cementing the bollard member to the foundation assembly within the housing part such that the inclination of the bollard member relative to the foundation assembly is adjustable while the cementing material is not set (e.g. cured or hardened or rigid) and is fixed upon the cementing material becoming set thereby to cement the inclination of the bollard member relative to the foundation assembly.

In this way, the inclination of the upstanding bollard relative to a local ground surface, in use, may be set as desired by the use of a controlled quantity of locally housed cementing material. By controlling the location and quantity of the cementing material, the housing part of the assembly enables minimal additional depth to the foundation assembly thereby enabling it to remain shallow and suitable for use in a shallow-mount bollard apparatus or assembly. The use of cementing material as an interface/coupling between the base end of the bollard member and the foundation assembly means that the whole immersed surface area of the bollard member is available for efficiently transferring impact forces from the bollard member (when subject to transverse impact) through the intervening cementing material and in to the foundation assembly—and thence into the ground. The area of interface may be adjusted simply by suitably adjusting the internal dimensions of the housing part and the quantity of cementing material it retains in use. The cementing material may act in the manner—at least to some extent—of a shock absorber.

The housing is preferably dimensioned and arranged for retaining the base end of the bollard member within the housing thereby to prevent the bollard member from being separated from the foundation assembly e.g. by virtue of the dimensioning of the housing. For example, the housing may be dimensioned to obstruct such separation. The base end of the bollard member may possess dimensions exceeding those of an opening in the foundation assembly through which the bollard member extends from its base end within the housing, thereby preventing passage of the base end through the opening and out of the housing.

It is to be understood that while the bollard apparatus is preferably a shallow-mount bollard assembly, the bollard apparatus may be other than a shallow-mount.

The foundation assembly may be adapted to be assembled with the bollard member(s) to provide a significant laterally extending foundation as a base or foot part, when fixed at the base of the upstanding bollard body, for engaging and extending across the ground, e.g. at the base of an excavation. The excavation may be subsequently filled in to bury the foot part (e.g. with earth, concrete or cement).

The foundation assembly may include an aperture arranged in register with the housing part and dimensioned to admit therethrough parts of the bollard member so as to extend from within the housing part between the base end of the bollard member and a top end of the bollard member in a direction transverse to the foundation assembly. The positioning and orientation of the aperture relative to the direction or axis of lateral extension of the foundation assembly defining the foot, may impose the transverse orientation of the bollard member when assembled therewith. The plane of the aperture may be parallel to the lateral extension of the foundation assembly. The foundation assembly may comprise a plate member which may be shaped to extend to define the foot and the plane of the aperture may be parallel to the plane in which the plate so extends. The aperture is preferably a circular aperture and the bollard member is preferably circular in cross section at its outermost surface of the parts thereof arranged to extend through the assembled bollard. Circularity has the benefit of having symmetry enabling adjustability of inclination in any tilt direction of the bollard member.

The thickness of the plate member of the foundation assembly is preferably no greater than 75 mm, more preferably no greater than 60 mm, and is preferably about 50 mm or 40 mm. The housing assembly preferably projects from the underside of the plate member, in use, in a direction transverse to the plate member by no more than about 175 mm, more preferably 150 mm, yet more preferably about 125 mm, yet more preferably about 100 mm or less (e.g. about 90 mm). Preferably, the separation between the upper surface of the plate member and the lowermost projecting parts of the housing part, in use, define the thickest portion of the foundation assembly. This separation is preferably less than about 250 mm, and more preferably less than 150 mm. Accordingly, the foundation assembly is preferably a shallow-mount foundation.

A transverse dimension (e.g. diameter, width etc) of the aperture may exceed a corresponding transverse dimension of those parts of the bollard member which the aperture is arranged to admit by an amount sufficient to define a gap therebetween within which the bollard member is moveable to adjust its inclination relative to the foundation member. The bollard member may be dimensioned, relative to dimensions of the aperture (e.g. the diameter and/or depth thereof) to extend through the aperture only in directions which may deviated from the perpendicular to the plane of the aperture by no more than 10 degrees, or 5 degrees, or 3 degrees.

A transverse dimension (e.g. diameter, width etc) of the aperture may exceed a corresponding transverse dimension of those parts of the bollard member which the aperture is arranged to admit by an amount sufficient to define a gap therebetween through which said cementing material is flowable to fill regions within housing part which surround the base end of the bollard member. In this way, the gap between bollard member and enveloping collar surfaces which enables tilt adjustment also enables ingress of cementing material into the chamber of the housing part. It also enables a "waggling" action to be applied to the free end of the bollard assembly to correspondingly "waggle" the housed base end thereof within the housing part to assist in distributing fluid cementing material around the chamber of the housing part to fill it and fully engulf the base end of the bollard member therein.

The housing part may thus define a sump for the cementing material to be drained into and retained for securing the bollard base end there. Preferably, a transverse internal dimension of the housing part (sump) exceeds a corresponding transverse dimension of the aperture such that parts of the foundation assembly defining the aperture appose (i.e. separated and opposing) internal surfaces of the housing part (sump) therewith to define a chamber for receiving the cementing material. That is to say, parts of the foundation assembly defining the aperture may preferably also define the ceiling of the chamber of the housing part. This overhanging/ceiling structure has important consequences for securing the bollard base end and the cementing material (once set/cured) when retained in the chamber of the housing part. It also provides a resistive surface for receiving forces transferred through the cementing material from the bollard member (when impacted), so that those forces may be dispersed along the rest of the foundation assembly efficiently. It prevents the cementing material being lifted out of the chamber of the housing part by the torque forces generated on the bollard member when subjected to transverse impact force.

A transverse dimension of the bollard member at or adjacent the base end of the bollard member may exceed a corresponding transverse dimension of the aperture such that the base end of the bollard is thereby prevented from passing through the aperture from within the housing part. This prevents the bollard member from being uprooted from the foundation assembly. The foundation assembly may include a plate member having a through-opening containing a fixed collar member upstanding from plate member at the periphery of the through-opening thereby defining the aperture of the foundation assembly at the outermost end of the collar (e.g. the collar end uppermost in use). The plate member may be a one-piece plate, such as a metal plate (e.g. steel) which may between 30 mm and 100 mm thick, or more preferably between 30 mm and 60 mm thick, or yet more preferably between 30 mm and 50 mm (e.g. about 40 mm) thick.

Preferably, the housing part extends/projects transversely from the surface of the plate member by no more than about 150 mm, and preferably by no more than about between 75 mm and 125 mm. This retains a shallow maximal depth to the foundation assembly.

The plate member is preferably shaped to define a plurality of tongue portions each separated from a neighbouring tongue portion by an intermediate bridging portion extending transversely therebetween. The plate member may have formed within it a plurality of through-openings each containing a respective said collar member in the manner described above. Each collar member is preferably fixed to the plate member at a respective position thereupon in register with a respective one of the tongue portions such that the tongue portion projects in a direction transverse to the length of the bollard member when received within the collar member.

The bollard member may include an anchor part adjacent the base end thereof and outwardly projecting therefrom in a direction transverse to the longitudinal axis thereof. The housing part is preferably dimensioned to receive the base end, the anchor part and sufficient cementing material to immerse the anchor part therein. The anchor part may be a plate (e.g. circular) with a central through-opening through which the axial/longitudinal body of the bollard member passes at its base end. The anchor part may be a circular ring plate fixed (e.g. welded) to the bollard member adjacent its base.

The bollard apparatus may include the cementing material in the form of a grout material, either in powdered form, in liquid form or in solid form e.g. (set/cured within the housing part).

The cementing material preferably has a compressive strength of between 50 $N/mm^2$ and 100 $N/mm^2$, more preferably between 60 $N/mm^2$ and 80 $N/mm^2$ (Newtons per millimetre squared). The cementing material preferably has a flexural strength of between 5 $N/mm^2$ and 15 $N/mm^2$, more preferably between 8 $N/mm^2$ and 11 $N/mm^2$ (Newtons per millimetre squared). The cementing material preferably has a static modulus of elasticity of between 15 $N/mm^2$ and 30 $N/mm^2$, preferably between 20 $N/mm^2$ and 25 $N/mm^2$ (Newtons per millimetre squared). The cementing material is most preferably a non-shrinkage material which substantially does not shrink in volume upon setting/hardening. A suitable cementing material is the commercially available product known as "Ultracrete HF—High Flow Precision Grout" (formerly known as "Cemflow HF") provided by the Instarmac® Group plc.

In a second of its aspects, the invention may provide a bollard comprising the bollard apparatus described above in assembled form in which said base end of the bollard member is housed together with said cementing material in said housing part thereby cementing the bollard member to the foundation assembly within the housing part such that the inclination of the bollard member relative to the foundation assembly is fixed by the cementing material at a desired inclination.

In a third of its aspects, the invention may provide a fixed vehicle barrier including one or more bollards according to the invention in its second aspect with bollard member(s) upstanding from a local ground level in which the one or more foundation assembly is buried thereby to fix it to the local ground level.

In a fourth aspect, the invention may provide a method of erecting a bollard for use as a fixed vehicle barrier including:

providing a bollard assembly including:

bollard member having a base end; and, a foundation assembly adapted for fixed ground engagement defining a housing part dimensioned and arranged for housing (e.g. retaining) the base end of the bollard member together with cementing material;

enclosing the base end within the housing part (e.g. thereby to retain the base end within the housing part);

engaging the foundation assembly with a ground surface with the bollard member upstanding;

placing cementing material within the housing part;

adjusting the inclination of the bollard member relative to the foundation assembly to a desired inclination while the cementing material is not set;

allowing the cementing material to set thereby to cement the inclination of the bollard member relative to the foundation assembly.

In a fifth of its aspects, the invention may provide a shallow-mountable bollard assembly comprising: a foundation assembly comprising a plate member arranged for ground engagement and shaped to define a plurality of tongue portions each separated from a neighbouring tongue portion by an intermediate bridging portion extending transversely therebetween; and, a plurality of bollard members each fixed to the plate member at a respective position thereupon in register with a respective one of the tongue portions such that the tongue portion projects in a direction transverse to the length of the bollard member.

Each of the tongue portions is preferably located at a common side of the plate member. The bollard assembly may comprise no more than two tongue portions, or no more than four tongue portions. The shallow-mountable bollard assembly may comprise the bollard apparatus described in the first aspect of the invention or the bollard of the second aspect of the invention, involving cementing material. Alternatively, the bollard members may be fixed to the plate member by welding. This may be by directly welding the bollard member to the plate member or by welding the bollard member within an intermediate collar member (such as described herein) which is itself welded to the plate member.

In a sixth of its aspects, the invention may provide a method of manufacturing a shallow-mountable bollard apparatus comprising: providing a rectangular plate; cutting the rectangular plate in to two plate halves each reciprocally shaped to define a plurality of tongue portions each separated from a neighbouring tongue portion by an intermediate bridging portion extending transversely therebetween; and, removing from at least one of the two plate halves parts excess plate parts which are neither a tongue portion or a bridging portion thereby to define a plate member for ground engagement; and, fixing each of a plurality of bollard members to one of the plate members at a respective position thereupon in register with a respective one of the tongue portions such that the tongue portion projects in a direction transverse to the length of the bollard member.

The rectangular plate may be cut in to two halves each reciprocally shaped to define four tongue portions.

The invention in any aspect preferably employs bollard a metal bollard member(s), and a metal foundation assembly. The metal is preferably steel.

A foundation assembly according the invention in any of its aspects described above may comprises a plate member arranged for ground engagement and at least one rib member attached thereto along a surface thereof to strengthen the foundation member against bending transversely to the rib. The foundation assembly may be shaped to define a plurality of tongue portions each separated from a neighbouring tongue portion by an intermediate bridging portion extending transversely therebetween. The foundation assembly may comprise at least one rib member attached thereto along a surface of one or each tongue member thereof to strengthen the tongue member against bending transversely to the rib. The foundation assembly may comprise at least one rib member attached thereto along a surface of the intermediate bridging portion thereof to strengthen the bridging portion against bending transversely to the rib. The rib may be a metal (e.g. steel) strip, such as a flat strip, welded or otherwise joined to the foundation assembly along one long strip edge such that the short strip edges are upstanding transversely (e.g. perpendicularly) from the surface to which the strip is joined. Alternatively, the rib may comprise a length of "angle iron" or a length of a girder or a beam. The one or more ribs may be joined to the foundation assembly at surface parts thereof extending from adjacent an intermediate bridging portion to parts of a tongue portion not so adjacent thereby to strengthen the parts of the foundation assembly where a tongue portion and the intermediate bridging portion meet. A plurality of ribs may be separately fixed to the foundation assembly in this region for this purpose. Preferably the rib(s) extents in a direction substantially parallel to, or at least along the length of, a tongue portion to which it (they) are fixed. This not only preferentially strengthens the tongue portions against bending along a bend line transverse to the tongue length, but also inhibits a sliding movement if the foundation assembly in such a transverse direction in response to impact forces. The upstanding rib(s) tend to dig in to a local ground material (e.g. cement or earth) with which the foundation assembly is buried within a filled-in excavation. This promotes a transfer of impact-induced movement of the foundation assembly to the distal ends of the tongue portions, furthest from the bollard parts, which may tend to dig into the local ground surface if the side of the foundation assembly nearest the bollards is tipped upwardly in response to the torques applied to the bollards by an impacting vehicle. This greatly resists further transverse movement of the foundation assembly. By providing tongue portions, the distal edge of the foundation assembly, furthest from the bollards is much shorter than the length of the foundation assembly. Thus, the impact forces transferred from the impacting vehicle to the ground surface through the intermediate foundation assembly, when pivoted or tipped upwardly as described above, are concentrated on a relatively limited distal edge length. This concentration of force increases the pressure applied to the ground surface by the distal edges of the tongue portions, further enhancing the tendency of the tongue portions to dig into the ground surface.

Reference is made, in the following, two examples which show possible embodiments of the invention, it being appreciated that other embodiments are encompassed within the scope of the invention.

Figure 1:
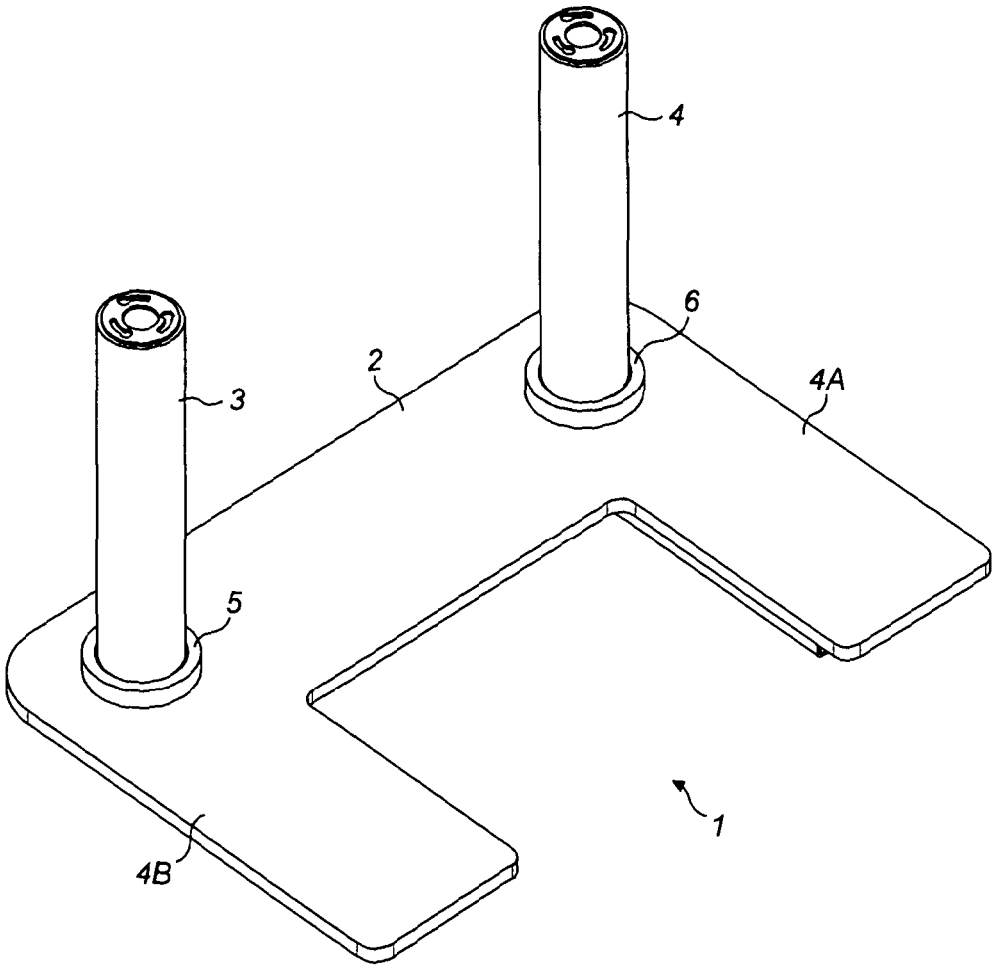
FIG. 1 shows a shallow-mount bollard assembly for a vehicle-impact barrier.

FIG. 1 illustrates a shallow-mount bollard assembly including a foundation assembly (2, 4A, 4B) shaped from a steel plate to define two tongue portions (4A, 4B) each separated from the other by an intermediate bridging portion (2) extending transversely there-between. The two separated tongue portions extend in parallel at a common side of the plate to define a flat and generally U-shaped footplate for ground engagement.

The thickness of the plate is approximately 400 mm (or thereabouts) thereby defining a very shallow foundation assembly for mounting the bollard assembly upon a ground surface at the base of a correspondingly shallow excavation within which the bollard assembly may be fixed by a shallow covering of concrete or other suitable burying material.

The bollard assembly comprises two separate bollard members (3, 4) each fixed to the foundation assembly at a respective position thereupon in register with a respective one of the two tongue portions (4A, 4B) such that a tongue portion projects from the base of an associated bollard member in a direction generally transverse to the length of that bollard member.

The two bollard members are also in register with the bridging portion (2) of the plate forming the foundation assembly with the result that the tongue portions (4A, 4B) of the foundation assembly both individually and collectively define a means for transferring to the ground upon which the bollard is engaged any transverse impact forces applied to a bollard member which urge the bollard member in the direction of the side of the foundation assembly containing the tongue members. For example, an impact from a vehicle driven into the bollard members at the tongue-free side of the bollard assembly would create transverse impact forces transferrable by one or each tongue portion into the ground upon which the bollard assembly rests.

By being positioned in register with the bridging portion (2) between tongue portions (4A, 4B), impact forces applied to any one of the bollard members (3, 4) may be efficiently transferred, at least in part, to a tongue portion which is not in register with the impacted bollard member. For example, impact forces experienced by bollard (4) of FIG. 1 may be transferred to associated tongue portion 4A and also transferred to neighbouring tongue portion 4B via the bridging portion (2) of the plate forming the foundation assembly. This is particularly advantageous when impact forces are applied in a direction which is not parallel to the direction in which the tongue portions project.

Each bollard member is secured to the foundation assembly via a respective aperture provided in the foundation assembly at positions in register with one of the two tongue portions, and with the bridging portion. Each aperture is defined by the uppermost opening of a collar member (5, 6) which is upstanding from the surface of the plate of the foundation assembly uppermost in use.

Most preferably each bollard member is a circularly cylindrical steel tube, each collar member is a circular steel collar defining a circular aperture and most preferably each collar member is fixed (e.g. by welding) within a through-opening formed in the plate of the foundation assembly. The plate is a steel one-piece plate.

While other than circular and cylindrical forms may be employed according to the invention, experience has shown that circular and cylindrical forms are most efficient in resisting impacts and in transferring impact forces through the structure of the bollard assembly.

Figure 2:
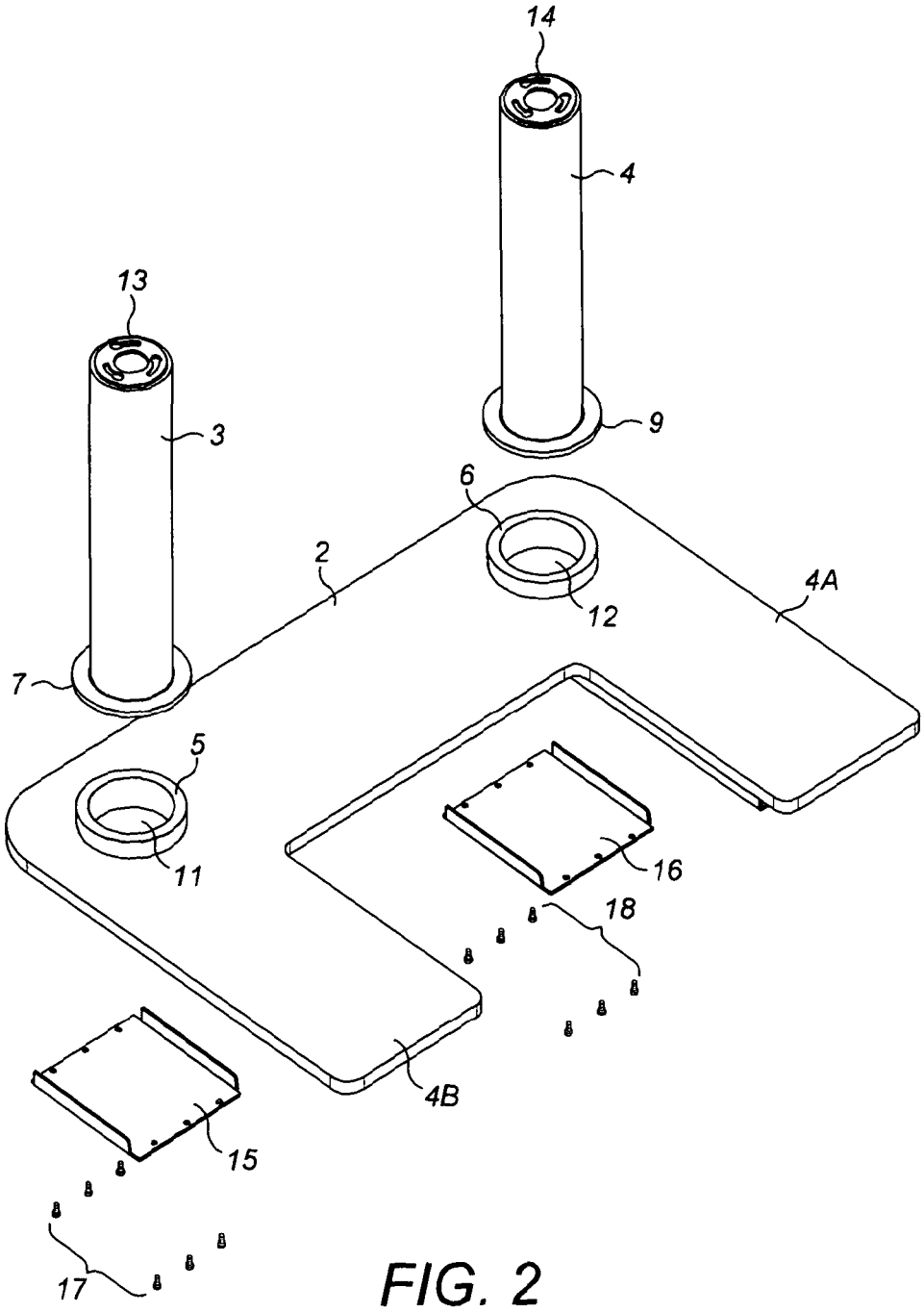
FIG. 2 shows the bollard assembly of FIG. 1 in exploded view.
Figure 3:
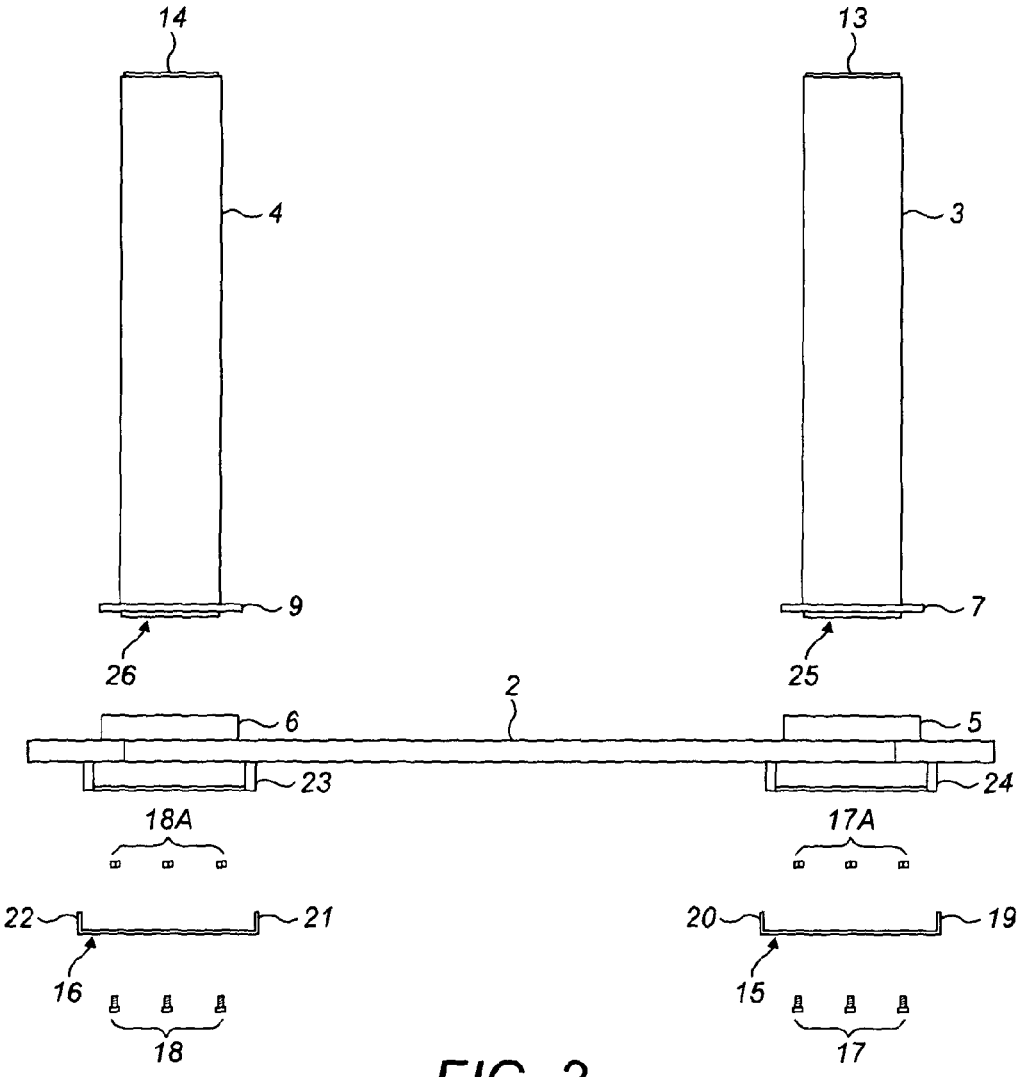
FIG. 3 shows the bollard assembly of FIG. 2 in exploded view from one side.

FIGS. 2 and 3 show exploded views of the bollard assembly of FIG. 1.

Each of the two upstanding circular collar members (5, 6) is positioned within a corresponding circular through-opening (11, 12) formed within the plate of a foundation assembly in register with respected tongue portions and the bridging portion. A housing part (15, 24 and 16, 23) is provided on a face of the plate of the foundation assembly reverse to that from which a collar member (5, 6) is upstanding and aligned in register with the through-opening of the plate and the aperture defined by a respective collar member. As a result a given through-opening in the plate of the foundation assembly is sandwiched between the upstanding parts of an associated collar member and the underlying housing part. The housing part and the parts of the face of the plate of the foundation assembly covered by the housing part, collectively define a housing for retaining the base end of a bollard member.

A housing part is provided separately for each of the two bollard members (3, 4), and is dimensioned and arranged for retaining a base end (25, 26) of the respective bollard member together with cementing material (not shown) for cementing the bollard member to the foundation assembly within the housing part.

Each housing part comprises a sump or chamber for enclosing and retaining an associated bollard base end and cementing material with which to encapsulate the retained bollard base end. Each housing part comprises an enclosure wall member (23, 24) surrounding the through-opening of the plate of the foundation assembly, and is upstanding from the underside of the plate. The housing part further includes a cover plate (15, 16) shaped and dimensioned to interface with the full periphery of the enclosure wall member with which it is associated therewith to define the chamber or sump as an enclosed volume.

An enclosure wall member may be square in shape comprising four straight walls joined at vertices defining a square surrounding the through-opening (11, 12) of the plate of the foundation assembly. The cover plate (15, 16) may be a correspondingly dimensioned square plate arranged to be fixed to the enclosure wall member by screws (17, 18) or bolts (with nuts 7A, 18A) or the like passing through the plate member into parts of the enclosure wall member, or by other suitable fixing means such as would be readily apparent to the skilled person.

Figure 7:
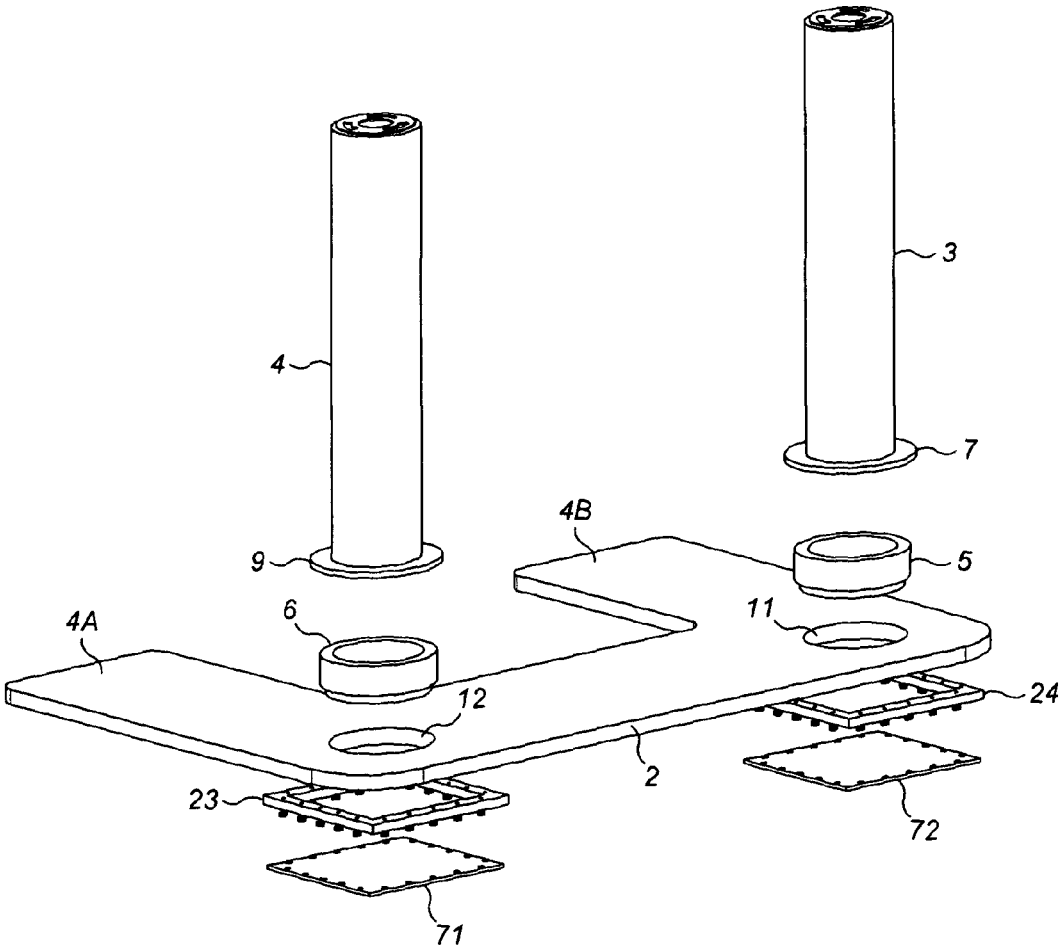
FIG. 7 illustrates a perspective exploded view of a variant of the bollard assembly shown, in part, in FIG. 6.

In the example illustrated in FIGS. 2 to 5 each cover plate comprises two parallel rows of bolt holes passing there through along two opposite parallel edges of the cover plate in which bolts (17, 18) of the housing part are arranged to pass and into the enclosure wall member to secure the cover plate member thereto. However, the remaining two parallel edges of the square cover plate (15, 16) each possess an upstanding right-angular lip, each one projecting in parallel with the other, therewith to embrace outermost edges of the enclosure wall member on opposite sides, preferably in a frictional grip, to prevent leakage of cementing material from within the chamber of the housing part in use without the need for securing bolts or screws. Conversely, in the example illustrated in FIG. 7, which is a variant of the example illustrated in FIGS. 1 to 5, the cover plate (71, 72) of a given housing part possesses bolt-receiving through-openings along each peripheral edge of the cover plate and requires securing bolts to be applied along each such edge to fix the cover plate to the enclosure wall member (23, 24) of the housing part.

Figure 4:
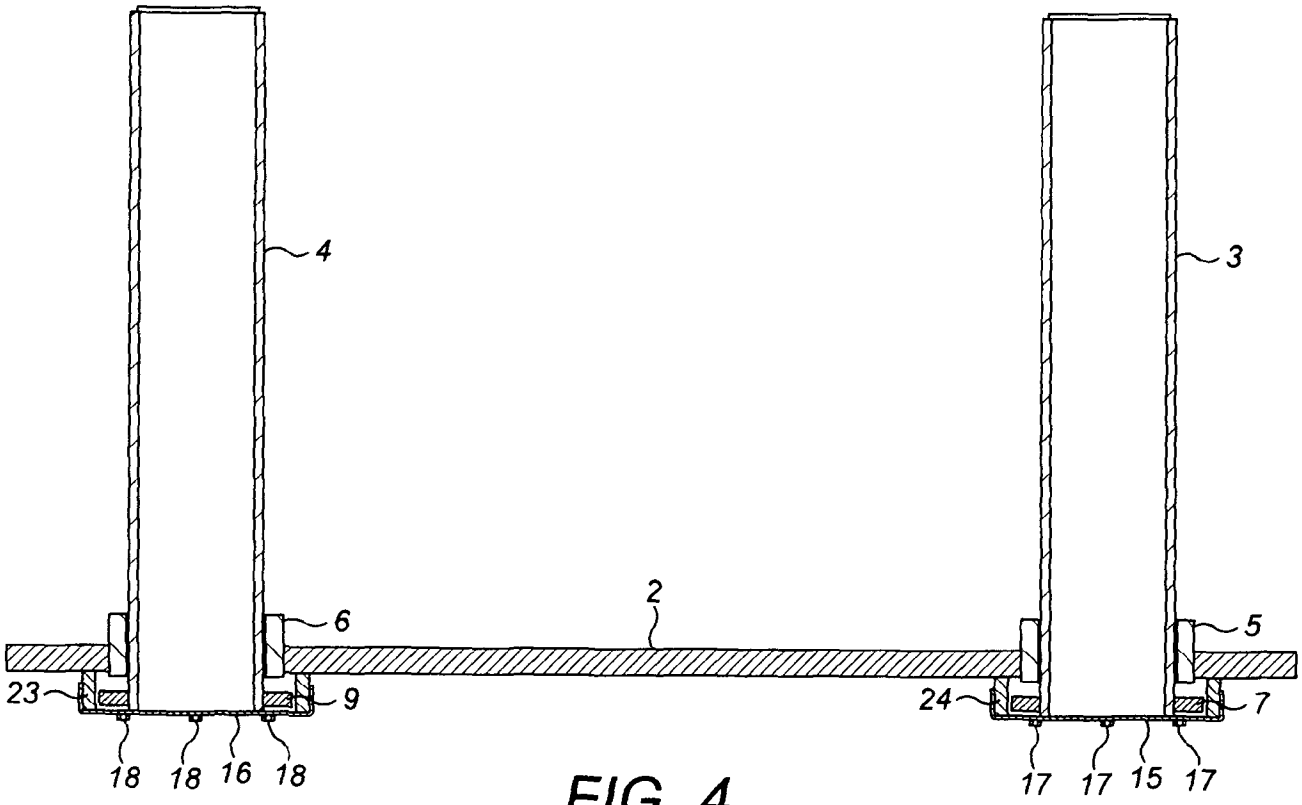
FIG. 4 shows a cross-sectional view of the bollard assembly of FIG. 1 from one side, being the same side as shown in FIG. 3.
Figure 5:
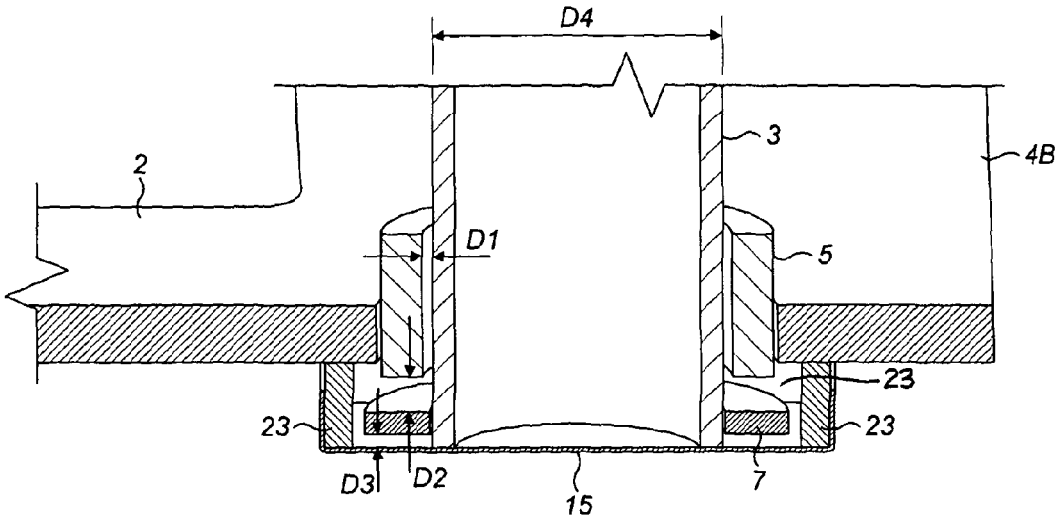
FIG. 5 shows a magnified view, in cross-section of a part of the bollard assembly of FIG. 4 comprising a housing part.

An anchor part (7, 9) is fixed by welding to the outer cylindrical surface of each respective bollard member (3, 4) and takes the form of a circumferentially projecting ring welded adjacent the base end of the respective bollard member. The anchor ring projects radially from the outer cylindrical surface of the bollard member to which it is welded. The outer diameter of the anchor ring (7, 9) exceeds the diameter of the aperture defined by a collar member (5, 6). The diameter of the aperture defined by a collar member exceeds the outer diameter of the tubular cylindrical bollard member adapted to pass through it. The result is that the base end of the bollard member is prevented from passing through the aperture in the foundation assembly through which other parts of the bollard assembly, closer to the uppermost end of the bollard assembly (13, 14) may pass. Accordingly, the bollard assembly illustrated in FIG. 1 may be assembled by passing an uppermost end (13, 14) of a bollard assembly through an associated collar member via the underside of the foundation assembly to which a housing part is attached. By pushing the cylindrical tubular body of the bollard assembly through the collar member, the anchor ring at the base end of the bollard assembly is positioned within the enclosure wall member (23, 24) of the housing part associated with the collar member in question. The cover plate (15, 16; 71, 72) may then be secured to the enclosure wall thereby to seal and encapsulate the base end and anchor ring of the bollard assembly within the cavity, volume or sump defined by the housing part. FIG. 4 shows a cross-sectional view of the bollard assembly of FIG. 1 in this assembled form. FIG. 5 shows a magnified view of the bollard base end, collar member, plate through-opening and associated housing part enclosing one of the two bollard members (3) illustrated in FIG. 4.

Referring to FIG. 5 in detail, the base end of a bollard member (3) is shown supporting by the uppermost surface of the cover plate (15) of the housing part presented inwardly to the chamber containing the bollard base end. The anchor ring (7) is fixed to the outer cylindrical surface of the bollard member at an axial position spaced from the base end by a distance D3 such that a space exists between the inward face of the cover plate and the opposing face of the anchor ring when the bollard member is perpendicular to the cover plate. Similarly, the collar member (5) extends through the through-opening formed in the plate (2) of the foundation assembly so as to extend into the cavity of the housing part to an extent such that a separation D2 exists between the end of the collar within the housing part and the opposing surface of the anchor ring. The diameter of the aperture defined by the collar member (5) exceeds the outer diameter (D4) of the bollard member (3) by an amount sufficient to permit a spacing D1 between the outer surface of the bollard member and the opposing inner surface of the collar member embracing it. The size of the spacing D1 may be varied by using a collar member (5) having one of a selectable range of different internal diameters.

The value of the spacing D1 may be varied by varying the internal diameter of the collar member (5) defining the aperture through which a bollard member is to extend. For example, a plurality of different collar members may be provided each having a common outer diameter matching the diameter of the through-opening in the plate of the foundation assembly within which it is to be secured, but having one of a number of different internal diameters defining the diameter of the aperture for receiving the cylindrical body of a bollard member.

Similarly, the value of the separation D2 between the opposing faces of the collar member and the anchor ring may be varied by inserting the lower end of the collar member through the through-opening in the plate of the foundation assembly by a desired amount in order to cause the lower end of the collar member to upstand from the underside of the plate by the desired amount before fixing (e.g. welding) the collar member to the plate.

Furthermore, the size of the separation D3 between the opposing surfaces of the anchor ring (7) and the cover plate (15) of the housing part may be selected by suitably selecting the axial position along the cylindrical body of the bollard member at which the anchor ring is fixed thereto.

Figure 6:
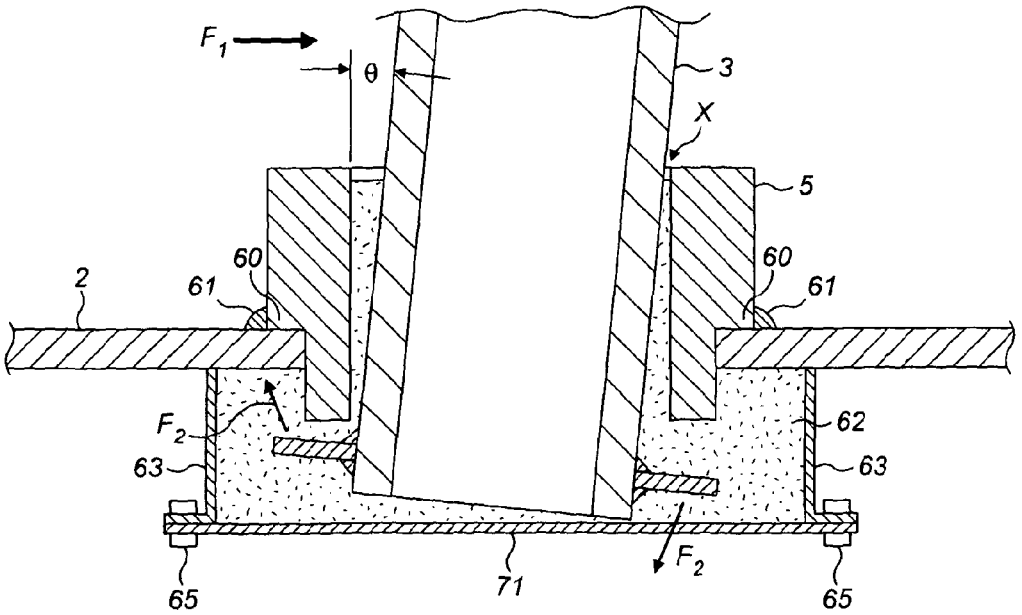
FIG. 6 illustrates a cross-sectional view of a part of the bollard assembly of FIG. 5 in which the housing part is filled with a cementing material in the form of grout.

The provision of the spacings D1, D2 and D3 enables fluid cementing material, preferably in the form of a high-flow-rate grout, to be inserted or injected into the inner volume of the housing part through the gap D1 between the collar member and the bollard member, to flow into the chamber of the housing part through the gap D2 between the anchor ring and the collar member around the outer periphery of the anchor ring and into the gap D3 between the anchor ring and the cover plate of the housing part (15). In this way the cementing material may entirely fill the volume of the chamber of sump defined by the housing part and fully encapsulate and immerse the anchor ring enclosed within it. Furthermore, the spacings D1, D2 and D3 also permit a tilting movement of the bollard member (3) relative to the foundation assembly and the collar member and housing part in particular. FIG. 6 illustrates an example of this.

Most preferably the cementing material (62) fills not only the chamber of the housing parts but also substantially fills the space between the inner surface of the collar member and the outer surface of the bollard member within it. Preferably the cementing material is located between the outer surface of the bollard member and opposing surfaces of the collar member so that the two do not form a direct contact. This enables the cementing material to form a shock-absorbing or dispersing barrier or interface between the bollard member and the foundation assembly, including the collar member.

While the cementing material (62) within the housing parts and collar member is still fluid, the bollard member (3) may be tilted relative to the foundation assembly by a relative inclination (θ) due to the maneuverability of the base parts of the bollard member retained within the housing part. Most preferably the values of D1, D2 and D3 are selected collectively to ensure that the maximum tilt inclination permissible by the collar member (5) is such that no part of the anchor ring (7) makes direct contact with the housing part or other parts of the foundation assembly when at that maximum inclination such that cementing material (e.g. grout) may still reside in spaces between the anchor ring and any part of the foundation assembly including the housing part. This may be achieved by suitably dimensioning the outermost diameter of the anchor ring, its axial location on the bollard member, the height of a collar member and the extent to which it projects into the inner volume of the housing part. This is in addition to suitable values of D1, D2 and D3. Suitable values for D1 and D2 are values between about 2.5 mm and about 7.5 mm (e.g. about 5 mm). Suitable values for D3 are values about twice the value of D2. The value of D4 may be between 150 mm and 250 mm (e.g. about 200 mm).

Once the suitable angle of inclination is selected the bollard member may be held at that inclination for a time sufficient to allow the cementing material to become set, hardened or cured so as to firmly secure and cement the inclination of the bollard relative to the foundation assembly.

If the cemented bollard member is subsequently impacted by a transverse impact force $F_1$ it will be urged in the direction towards those parts of the collar member located at the side of the bollard member opposite to the point of impact. Cementing material (e.g. grout) which has set at these locations (location X indicated in FIG. 6) and the adjacent parts of the collar member serve as a fulcrum about which lower parts of the bollard member (3) are urged to pivot, and are urged to push through the cementing material (62) which envelops those parts.

The compressive strength, flexural strength and modulus of elasticity of the cementing material, suitably chosen, serves substantially to prevent pivoting movement of the bollard member and to efficiently disperse impact shock from the bollard member, through the cementing material, into the foundation assembly and thereafter into the ground where the bollard assembly is shallow-mounted.

Most preferably the cementing material is a high-flow-rate grout having a compressive strength of between 50-100 newtons per $mm^2$, having a flexural strength of between 5 and 15 newtons per $mm^2$ and preferably having a static modulas of elasticity of between 15 and 30 newtons per $mm^2$. Cementing material satisfying these conditions has been found to be particularly effective in transmitting the forces $F_2$ generated by a bollard member (3) when subject to the impact force $F_1$.

It is to be noted that the embodiment illustrated in FIG. 6 contains minor variations in design relative to the embodiments illustrated in FIGS. 1 to 5 and these include the use of a wholly flat cover plate (71) together with enclosure walls (63) which terminate with a right-angular lip projecting outwardly of the housing part and against which the flat cover plate (71) can be pressed and joined thereto by nut and bolt assemblies (65) passed through suitably prepared apertures in the cover plate and the lip in register. This arrangement enables simple nut-and-bolt fastening means to be employed which are easily accessible during assembly of the bollard as closure of the housing part.

Furthermore, a collar member (5, 6) may have a stepped outer diameter in which the lesser outer diameter is dimensioned to the closely received within, and preferably through a through-opening (11, 12) formed within the plate of the foundation assembly (2, 4A, 4B) whereas the greater outer diameter exceeds that of the through-opening thereby to define a circumferential shoulder (60) extending around the outer surface of the collar member dimensioned to receive the peripheral edge of those parts of the plate of the foundation assembly (2) defining the through-opening.

Welding (61) fixes the collar member to the plate of the foundation assembly, and similar such welds (not shown) may be used in any other embodiment of the invention illustrated herein.

Figure 8:
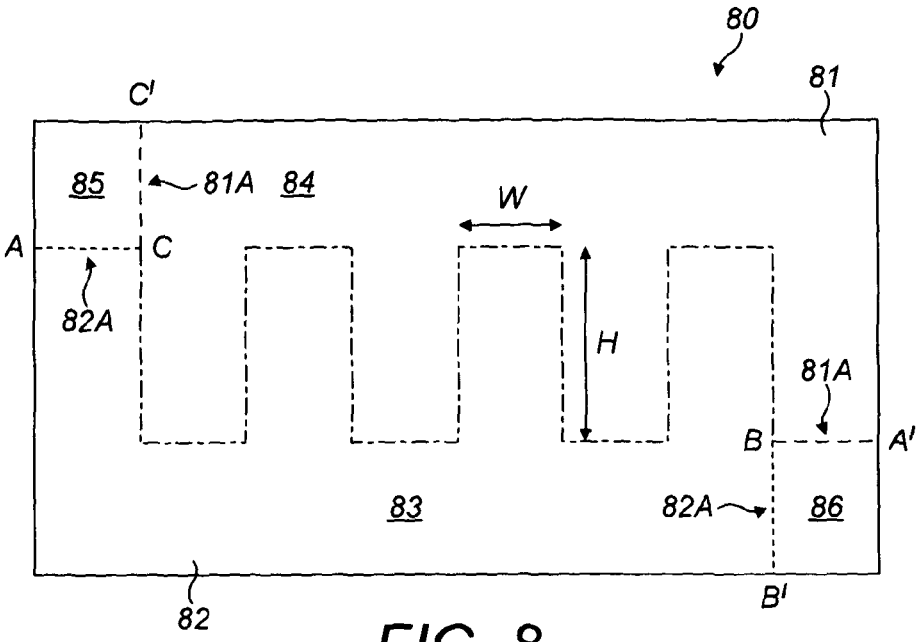
FIG. 8 illustrates a plate and a cut line extending there across defining two reciprocally shaped plate halves each for use in manufacturing a foundation assembly for a bollard assembly.

FIG. 8 schematically illustrates a steel plate (80) being rectangular in shape having a length of 5.6 m and a width of 4.3 m. Such a dimension of rectangular steel plate represents a standard size of manufacture and supply of steel plates by manufacturers.

The invention, in one of its aspects, may comprise cutting the steel plate (80) into two halves (81, 82) defined by a crenulated cut path starting at a start point A' at one of the two short edges of the rectangular plate and ending at an end point (A) at the other of the two short edges of the rectangular plate.

The cut path (A'-A) is shaped to define crenulations in each of the two halves produced by the cut path which are reciprocal to each other. The cut path comprises only path sections which are either parallel to the long edges of the rectangular plate or are parallel to the short edges of the rectangular plate. The cut path consists of successive path sections which are perpendicular to each other. In this way a given path section is perpendicular to the path sections which preceded and succeeded it, and the preceding and succeeding path sections are parallel and of the same length. The cut path is symmetrical about a line joining the centers of the two short edges of the rectangular plate. The rectangular plate is cut into halves of equal area each half defining a plate member comprising a long straight edge and a long crenulated edge in which the crenulations are rectangular or square crenulations. The separation between the crenulations matches the width of each crenulation.

Each such plate half thereby defines a plate member shaped to define a plurality of tongue portions of height H and width W each separated by a distance W from the neighbouring tongue portion by an intermediate bridging portion (83, 84) extending transversely therebetween.

Subsequently excess plate parts (85, 86) which are neither a tongue portion or a bridging portion are removed from each plate half by cutting along a line (81A, 82A) extending the edge of the tongue part immediately adjacent to the excess plate part from point B to B' on a first of the two plate halves (82) and from point C to a on a second of the two plate halves (81).

As a result, two plate members are formed from one common rectangular steel plate in which each plate member is the same shape as the other and each serves for use as the plate part of a foundation assembly in a bollard assembly such as described above or otherwise.

Figure 9:
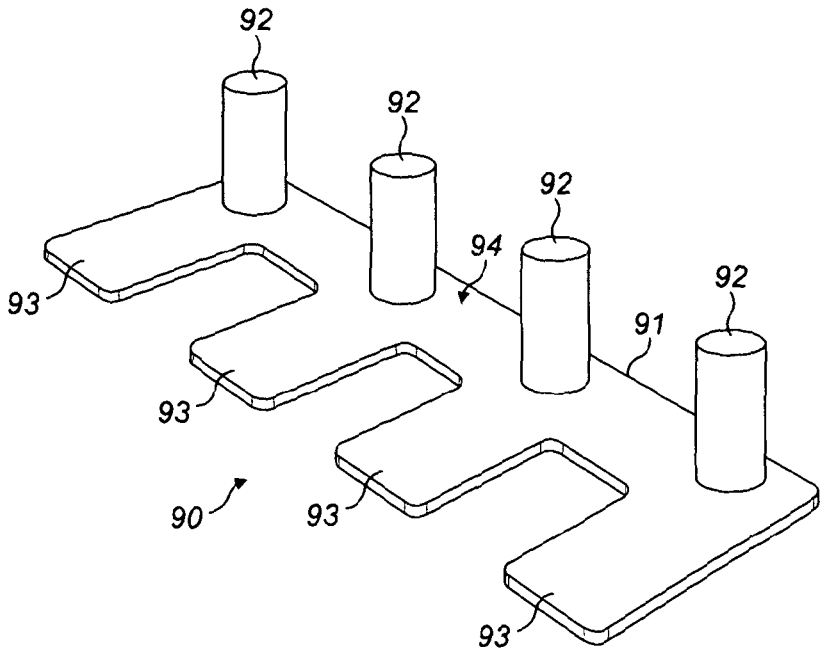
FIG. 9 illustrates a view of a bollard assembly comprising a foundation plate to which are fixed multiple bollards; the foundation plates being manufactured from a plate half as illustrated in FIG. 8.

A four-bollard shallow-mount barrier assembly is then constructed by fixing a respective one of four bollards (92) to a plate member (91) at their respective position thereupon in register with a respective one of the four tongue portions (93) and in register with associated bridging portions (94) such that the associated tongue portion projects in a direction transverse of the bollard member (92) placed in register with it. An example of this is schematically illustrated in FIG. 9.

To achieve this, for example, a row of through-openings (not shown) may then be formed in a plate member at locations in register with a respective one of the four tongue portions and an associated bridging portion. The base of bollard members (92) may then be inserted into respective through-openings (not shown) in the plate member (91) and secured thereto either according to the methods described above in relation to FIGS. 1 to 7, or by other means such as by directly welding the bollard members to the plate member at or around the edges of the through-opening.

The four-bollard barrier assembly may then be shallow-mounted in a shallow excavation dimensioned to receive the plate member (91) at shallow depth to be fixed in place by a suitable covering of concrete or the like thereby to bury the plate member and the foundation assembly it defines.

The thickness of the steel sheet (80) may be between 2 cm and 5 cm (e.g. 4 cm) most preferably, but other thicknesses may be used.

While the above example is illustrated in terms of a four-tongued foundation assembly, the manufacturing method may be applied analogously, in a manner as would be readily apparent to the skilled person, to cut a rectangular plate in two halves comprising any number of tongue portions such as two, four or more than four. This may be achieved by initially selecting a plate (80) of suitable dimensions and/or varying the width W of a given tongue portion such that:

$$W=L/2N$$

where L is the length of the long edge of the rectangular plate (80) and N is the number of tongue portions required in each of the halves cut from the plate. The quantity W is defined above with reference to FIG. 8.

Figure 10:
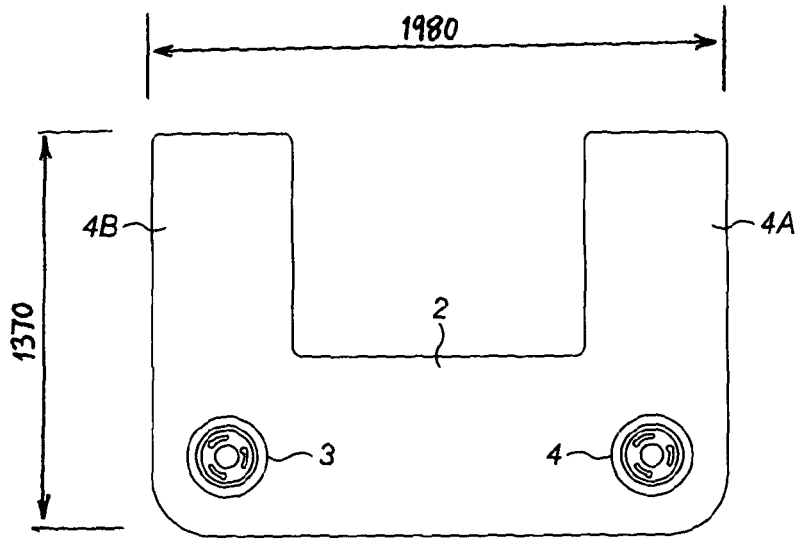
FIG. 10 shows a plan view of a bollard assembly including certain dimensions.
Figure 11:
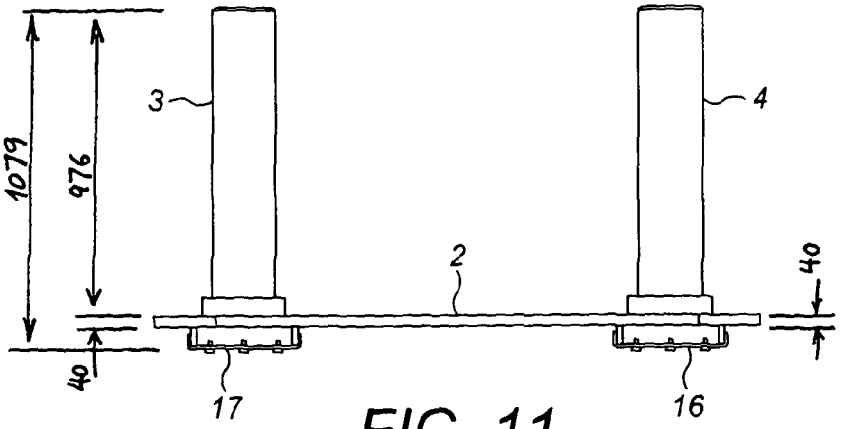
FIG. 11 shows a front view of a bollard assembly of FIG. 10, including certain dimensions.
Figure 12:
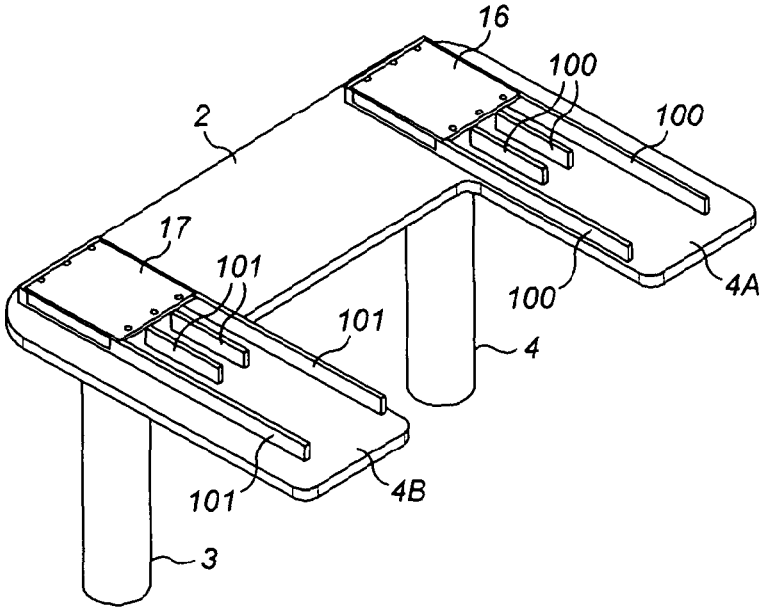
FIG. 12 shows an underside view of a bollard assembly of FIGS. 10 and 11.
Figure 13:
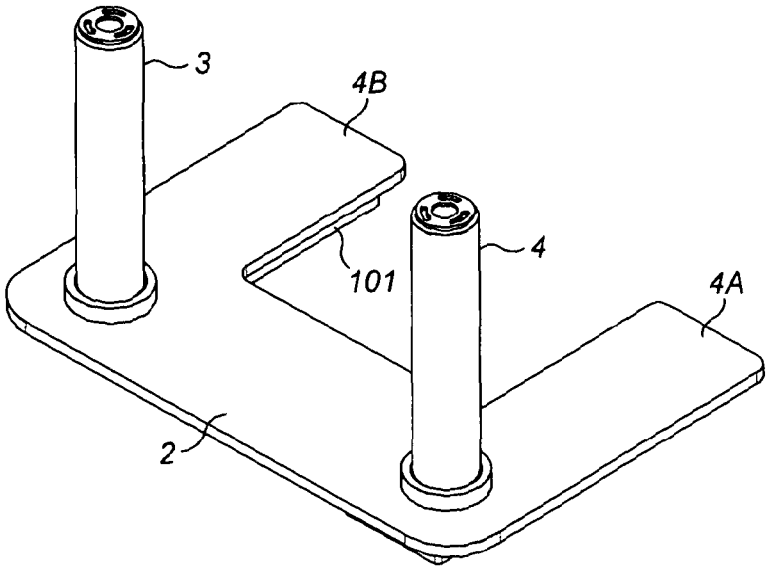
FIG. 13 shows a perspective view of the bollard assembly of FIGS. 10 to 12.

FIGS. 10 to 16 show views of a further embodiment of the invention described above with reference to FIGS. 1 to 9. Referring to FIG. 12, the foundation assembly (2, 4A, 4B) of the bollard assembly comprises four rib members (100) welded to and along the underside surface of one of the two tongue portions (4A) of the plate part of the foundation assembly to strengthen the foundation member against bending transversely to the rib members. The foundation assembly also comprises four rib members (101) welded to and along the underside surface of the other one of the two tongue portions (4B) of the plate part of the foundation assembly to strengthen the foundation member against bending transversely to the rib members. FIG. 11 and FIG. 13 show a front view and a perspective (top) view, respectively of the bollard assembly of FIG. 12. Each of the eight rib members extends linearly from a region of the foundation assembly adjacent to the intermediate bridging portion (2) to regions further along the tongue portion not adjacent to the bridging portion towards the distal edge of the tongue.

Figure 15:
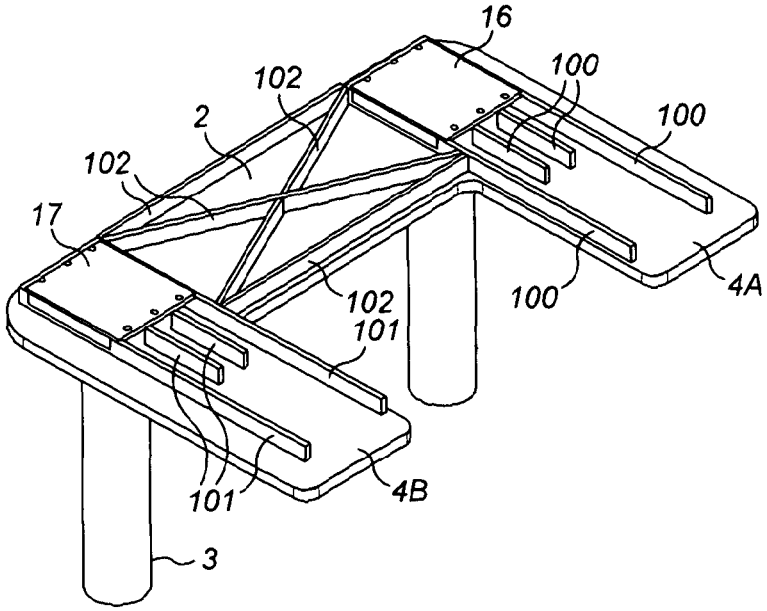
FIG. 15 shows an underside view of a bollard assembly of FIG. 14.
Figure 14:
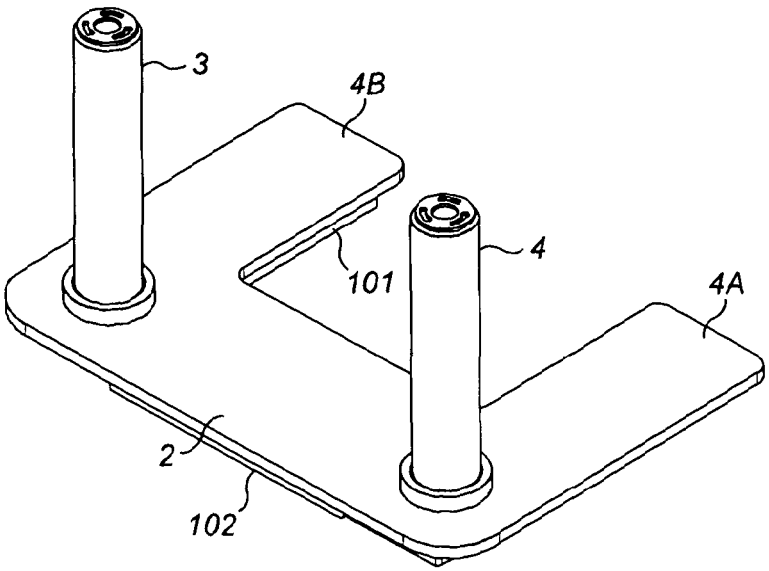
FIG. 14 shows a perspective view of the bollard assembly.
Figure 16:
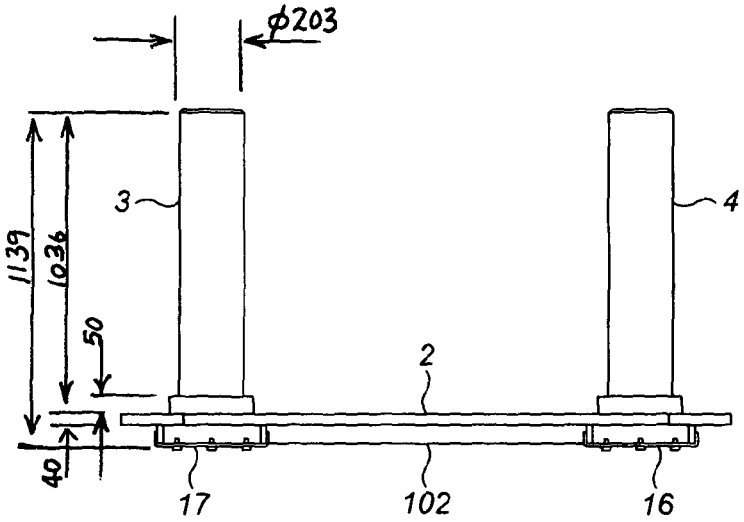
FIG. 16 shows a front view of a bollard assembly of FIGS. 14 and 15. In the drawings like articles are assigned like reference symbols.

FIGS. 14, 15 and 16 show a further embodiment of the invention in which five further rib members (102) are welded to the underside of the foundation plate along a surface of the intermediate bridging portion thereof to strengthen the bridging portion against bending transversely to the rib. One rib member extends from one tongue portion to the other diagonally, two rib portions each separately extend directly, in parallel, across the bridging portion being separated from each other by the width of the bridging portion, and two other shorter rib members extent in succession in a direction diagonally transverse to, and across, the aforementioned diagonal rib member from one tongue portion to the other.

The rib is a flat metal (e.g. steel) strip, welded to the foundation assembly along one long strip edge such that the short strip edges are upstanding transversely (e.g. perpendicularly) from the surface to which the strip is joined.

FIG. 10 shows a plan view of a bollard assembly according to embodiments of the invention described above indicating the relative dimensions of the foundation assembly—namely, 1980 mm wide, and 1370 mm from front edge to back edge. FIG. 11 shows other dimensions of the embodiment comprising the height of a bollard upstanding from the upper surface of the foundation assembly (976 mm), the thickness of the plate of the foundation assembly (40 mm), and the overall height of the bollard assembly including the sump part (1079 mm). The diameter of a bollard is 203 mm.

The above examples are provided for the purposes of illustrating and are not intended to be limiting of the scope of the invention. Modifications, variants and alternatives to aspects of the invention described above, such as would be readily apparent to the skilled person, are intended to be encompassed by the scope of the invention, such as is defined by the claims.

The invention claimed is:

1. A bollard apparatus for use as a fixed vehicle barrier including:

a bollard member having a base end; and, a foundation assembly adapted for fixed ground engagement;

wherein the foundation assembly defines a housing part dimensioned and arranged for retaining the base end of the bollard member together with cementing material for cementing the bollard member to the foundation assembly within the housing part such that the inclination of the bollard member relative to the foundation assembly is adjustable while the cementing material is not set and is fixed upon the cementing material becoming set thereby to cement the inclination of the bollard member relative to the foundation assembly; and wherein the foundation assembly includes an aperture arranged in register with the housing part and dimensioned to admit therethrough parts of the bollard member so as to extend from within the housing part between the base end of the bollard member and a top end of the bollard member in a direction transverse to the foundation assembly and the foundation assembly includes a plate member having a through-opening containing a fixed collar member upstanding from plate member at the periphery of the through-opening thereby defining said aperture at the outermost end of the collar.

2. A bollard apparatus according to claim 1 in which a transverse dimension of the aperture exceeds a corresponding transverse dimension of those parts of the bollard member which the aperture is arranged to admit by an amount sufficient to define a gap therebetween within which the bollard member is moveable to adjust its inclination relative to the foundation member.

3. A bollard apparatus according to claim 1 in which a transverse dimension of the aperture exceeds a corresponding transverse dimension of those parts of the bollard member which the aperture is arranged to admit by an amount sufficient to define a gap therebetween through which said cementing material is flowable to fill regions within housing part which surround the base end of the bollard member.

4. A bollard apparatus according to claim 1 in which a transverse dimension of the base end of the bollard member exceeds a corresponding transverse dimension of the aperture such that the base end of the bollard is thereby prevented from passing through the aperture from within the housing part.

5. A bollard apparatus according to claim 1 in which the housing part defines a sump, a transverse dimension of which exceeds a corresponding transverse dimension of the aperture such that parts of the foundation assembly defining the aperture appose internal surfaces of the sump therewith to define a chamber for receiving said cementing material.

6. A bollard apparatus according to claim 1 in which the bollard member includes an anchor part fixed adjacent the base end thereof and outwardly projecting therefrom in a direction transverse to the longitudinal axis thereof wherein the housing part is dimensioned to receive the base end, the anchor part and sufficient cementing material to immerse the anchor part therein.

7. A bollard comprising said bollard apparatus according to claim 1 in assembled form in which said base end of the bollard member is retained together with said cementing material in said housing part thereby cementing the bollard member to the foundation assembly within the housing part such that the inclination of the bollard member relative to the foundation assembly is fixed by the cementing material at a desired inclination.

8. A method of erecting a bollard for use as a fixed vehicle barrier including:

providing a bollard assembly including:

bollard member having a base end; and, a foundation assembly adapted for fixed ground engagement comprising a housing part dimensioned and arranged for housing the base end of the bollard member together with cementing material; and, wherein the foundation assembly includes an aperture arranged in register with the housing part and dimensioned to admit therethrough parts of the bollard member so as to extend from within the housing part between the base end of the bollard member and a top end of the bollard member in a direction transverse to the foundation assembly and the foundation assembly includes a plate member having a through-opening containing a fixed collar member upstanding from plate member at the periphery of the through-opening thereby defining said aperture at the outermost end of the collar;

enclosing the base end within the housing part;

engaging the foundation assembly with a ground surface with the bollard member upstanding;

placing cementing material within the housing part;

adjusting the inclination of the bollard member relative to the foundation assembly to a desired inclination while the cementing material is not set;

allowing the cementing material to set thereby to cement the inclination of the bollard member relative to the foundation assembly.

9. A method of manufacturing a shallow-mountable bollard apparatus comprising:

providing a rectangular plate;

cutting the rectangular plate in to two plate halves each reciprocally shaped to define a plurality of tongue portions each separated from a neighbouring tongue portion by an intermediate bridging portion extending transversely therebetween; and, removing from at least one of the two plate halves parts excess plate parts which are neither a tongue portion or a bridging portion thereby to define a plate member for ground engagement; and, fixing each of a plurality of bollard members to one of the plate members at a respective position thereupon in register with a respective one of the tongue portions such that the tongue portion projects in a direction transverse to the length of the bollard member.

10. A method according to claim 9 including cutting the rectangular plate in to two halves each reciprocally shaped to define four said tongue portions.

* * * * *